US010267051B2

(12) United States Patent
Elduayen Madariaga et al.

(10) Patent No.: US 10,267,051 B2
(45) Date of Patent: Apr. 23, 2019

(54) FORMWORK TUBE

(71) Applicants: 20 EMMA 20 S.L., Aduna (ES); HEGAIN 2100 CONSULTING S.L., Irun (ES)

(72) Inventors: Juan Andrés Elduayen Madariaga, Aduna (ES); Javier Sanchez Garduño, Irun (ES)

(73) Assignees: 20 EMMA 20 S.L., Aduna (ES); HEGAIN 2100 CONSULTING S.L., Irun (ES)

( * ) Notice: Subject to any disclaimer, the term of this patent is extended or adjusted under 35 U.S.C. 154(b) by 0 days.

(21) Appl. No.: 15/796,142

(22) Filed: Oct. 27, 2017

(65) Prior Publication Data

US 2018/0044930 A1 Feb. 15, 2018

Related U.S. Application Data

(63) Continuation of application No. PCT/EP2016/059482, filed on Apr. 28, 2016.

(30) Foreign Application Priority Data

Apr. 30, 2015 (EP) ..... 15382223

(51) Int. Cl.
*E04G 17/065* (2006.01)
*E04G 17/06* (2006.01)

(52) U.S. Cl.
CPC ..... *E04G 17/0657* (2013.01); *E04G 17/0644* (2013.01); *E04G 17/0655* (2013.01); *E04G 2017/0611* (2013.01)

(58) Field of Classification Search
CPC ..... E04G 17/0657; E04G 2017/0611; E04G 17/0655; E04G 17/0644
(Continued)

(56) References Cited

U.S. PATENT DOCUMENTS 842,722 A * 1/1907 Swinnerton ..... E04G 17/0714 249/115
929,470 A * 7/1909 Neil ..... E04G 11/28 249/20
(Continued)

FOREIGN PATENT DOCUMENTS

CH 144519 A 1/1931
CN 202882424 U 4/2013
(Continued)

OTHER PUBLICATIONS

European Search Report in corresponding European Patent Application No. 15382223.4, dated Oct. 15, 2014.
(Continued)

*Primary Examiner* — Michael Safavi
(74) *Attorney, Agent, or Firm* — Edell, Shapiro & Finnan, LLC

(57) ABSTRACT

Formwork tube consisting of a first portion with a first conical end, and a second portion with a second conical end. The first portion and the second portion are coupled to each other, so that the tube can be completely extracted from the formwork after use. The first portion is extracted from one of the sides of the formwork while the second portion is extracted from the other side of the formwork. The formwork tube is suitable for housing therein a transverse tie rod.

19 Claims, 3 Drawing Sheets

(58) Field of Classification Search
USPC ..... 428/36.92, 36.9, 35.7, 36.6; 249/42, 43, 249/190, 216
See application file for complete search history.

(56) References Cited

U.S. PATENT DOCUMENTS 1,309,084 A * 7/1919 Zimmerman ..... E04G 15/063 249/177
1,723,631 A * 8/1929 Pollock ..... E04G 17/0658 249/42
1,767,834 A * 6/1930 Carlson ..... E04G 17/0752 249/217
1,875,463 A * 9/1932 Jones ..... E04G 17/0754 249/175
1,907,618 A * 5/1933 Umbach ..... E04G 17/0752 249/217
2,098,389 A * 11/1937 Howard ..... F16L 5/00 126/317
2,411,678 A * 11/1946 Cornella ..... E04G 17/0652 249/217
2,523,131 A * 9/1950 Martin ..... E04G 11/10 249/190
3,181,832 A * 5/1965 Chianese ..... E04G 17/0714 249/43
3,328,055 A * 6/1967 Lang ..... F16L 15/08 138/89
3,400,182 A * 9/1968 Kolt ..... B29C 44/18 249/117
3,523,552 A * 8/1970 Ogden ..... E04G 15/061 137/592
3,822,860 A * 7/1974 Lovisa ..... E04G 17/0714 249/190
3,926,404 A * 12/1975 Lovisa ..... E04G 17/0714 249/213
3,927,857 A * 12/1975 Lovisa ..... E04G 17/0735 249/217
4,079,912 A * 3/1978 Haydock ..... B28B 7/30 249/184
4,159,097 A * 6/1979 Strickland ..... E04G 17/0652 249/190
4,223,740 A * 9/1980 Clayton ..... A62C 31/00 169/68
4,598,519 A * 7/1986 Reid ..... E04B 2/8647 249/216
5,360,242 A * 11/1994 Argent ..... E21B 17/0426 228/189
5,405,119 A * 4/1995 Maguire ..... B28B 7/18 249/183
5,497,592 A * 3/1996 Boeshart ..... E04B 2/8647 249/43
5,537,797 A * 7/1996 Harkenrider ..... E04G 9/05 52/745.13
5,634,311 A * 6/1997 Carlton ..... E02B 11/005 285/903
5,813,185 A 9/1998 Jackson
5,921,591 A * 7/1999 Argent ..... E21B 17/0426 228/135
6,837,473 B2 * 1/2005 Petkau ..... E04G 17/0657 249/190
6,945,506 B2 * 9/2005 Long, Sr. ..... E04C 2/044 249/190
7,895,726 B2 * 3/2011 Maguire ..... E21B 43/106 166/207

FOREIGN PATENT DOCUMENTS

| | | | | |
|---|---|---|---|---|
| CN | 203603484 U | | 5/2014 | |
| DE | 1534955 A1 | | 7/1969 | |
| DE | 3416862 A1 | * | 11/1985 | ..... E04G 17/06 |
| DE | 3840757 | * | 1/1990 | ..... E04G 17/06 |
| DE | 3840757 C1 | * | 1/1990 | ..... E04G 17/06 |
| DE | 29606871 U1 | * | 9/1996 | ..... E04G 17/0644 |
| EP | 0821121 A1 | * | 1/1998 | ..... E04G 17/0644 |
| FR | 972190 A | | 1/1951 | |
| FR | 2933436 A1 | | 1/2010 | |
| JP | S5612654 U | | 2/1981 | |
| JP | S5754566 U | | 3/1982 | |

OTHER PUBLICATIONS

International Search Report in corresponding PCT Application No. PCT/EP2016/059482, dated Jul. 15, 2016.

* cited by examiner

FORMWORK TUBE

CROSS-REFERENCE TO RELATED APPLICATIONS

This applications relates to and claims the benefit and priority to International Application No. PCT/EP2016/059482, filed Apr. 28, 2016, which relates to and claims the benefit and priority to European Application No. EP15382223.4, filed Apr. 30, 2015. Each of International Application No. PCT/EP2016/059482 and European Application No. EP15382223.4 is incorporated herein by reference in its entirety.

TECHNICAL FIELD

The present invention relates to formwork tubes that are used for protecting transverse tie rods used for securing formwork panels.

BACKGROUND

Concrete walls are made on site providing a gap between two formwork panels that are arranged such that they are facing one another. Said panels are secured to one another by means of transverse tie rods which have threaded ends and which project from the formwork panels to enable screwing in the corresponding nuts.

Once the panels are secured to one another, concrete is poured into the gap which is arranged sandwiched between the formwork panels. To prevent the concrete from adhering to the transverse bolts once it has set, these bolts are usually covered by or placed inside a tube beforehand. Once the concrete has set, the formwork panels and the transverse bolts are disassembled. Upon being disassembled, said bolts generate through holes on the concrete wall that must be closed and sealed to prevent leaks in the wall.

Extraction of the tube is optional and largely depends on the application of the wall. For example, in concrete walls intended for containing a fluid in which correct sealing of the wall is very important, such as, for example, water tanks, swimming pools, lubricant tanks, etc., it is suitable to extract said tube for assuring the leak-tightness of the wall.

In this sense, U.S. Pat. No. 5,813,185 discloses a cylindrical tube housing therein a transverse tie rod which is used for securing two formwork panels arranged parallel to one another. A conical end is removably coupled at each end of the tube.

SUMMARY OF THE DISCLOSURE

According to one embodiment a formwork tube is provided that comprises a first portion with a first conical end, and a second portion with a second conical end. The first portion and the second portion are coupled to each other in a manner that allows them to be decoupled so that the tube can be completely extracted from the formwork after use. This allows the first portion of the tube to be extracted from one of the sides of the formwork and allows the second portion of the tube to be extracted from the other side of the formwork.

The manner in which the formwork tube is constructed allows the entire tube to be extracted with little physical effort and without damaging the concrete wall.

Both portions of the tube are coupled to each other so that one portion is centered with respect to the other and therefore any misalignment is avoided. Additionally, any gap in the contact area between both portions is avoided and the concrete cannot penetrate to the interior of the tube.

The formwork tube is also prevented from being damaged during the extraction process enabling it to be reused.

These and other advantages and features will become evident in view of the drawings and the detailed description.

DETAILED DESCRIPTION

According to one embodiment a formwork tube 1 is provided that includes a first portion A with a first conical end 3*a*, and a second portion B with a second conical end 3*b*. The first portion A and the second portion B are coupled to each other, so that the tube 1 can be completely extracted from the formwork after use by just pulling the portions A and B out. The first portion A is extracted from one of the sides of the formwork while the second portion B is extracted from the other side of the formwork, therefore the entirety of the tube 1 can be extracted from the concrete wall, once the concrete has set, without exerting hardly any physical effort and reducing the extraction time drastically.

Since both portions A and B of the tube 1 are coupled to each other, one portion is centered with respect to the other and therefore any misalignment is avoided. Additionally, any gap in the contact area between both portions A and B is avoided so that the concrete cannot penetrate to the interior of the tube 1. If the contact is not guaranteed between the two portions A and B, as it occurs in the tubes of the prior art, the tube 1 will have a discontinuity and the concrete would penetrate to the interior of the tube 1.

According to one embodiment, both portions A and B are coupled to each other by means of a protrusion 4 that projects from one of the portions A or B and is housed inside the other portion. According to one embodiment the protrusion 4 is cylindrical.

The coupling area of both portions A and B, i.e the contact area in the axial direction between portion A and portion B, defines a partitioning plane X from which the protrusion 4 projects. Said partitioning plane X is preferably transverse, i.e perpendicular, to the longitudinal axis of the tube 1. It is also possible that the plane X is an inclined plane.

To facilitate the coupling of the first portion A into the second portion B, the protrusion 4 may comprise a chamfer 4' at its free end which aids in introducing the first portion A into the second portion B.

According to one embodiment the first portion A comprises a first cylindrical segment 2*a* joined to the first conical end 3*a* and the second portion B comprises a second cylindrical segment 2*b* joined to the second conical end 3*b*, both segments 2*a* and 2*b* forming a central portion 2 of the tube 1. The conical ends 3*a* and 3*b* provide a larger support surface so that the corresponding formwork panel 6 is correctly supported on the tube 1, obtaining good stability when assembling the formwork.

Figure 1A:
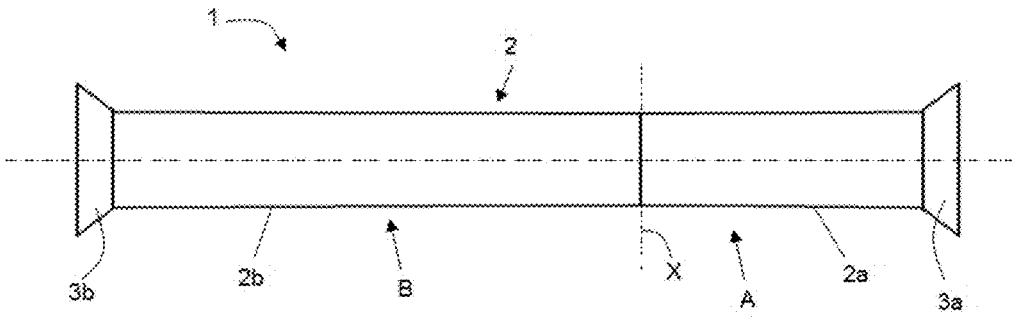
FIG. 1A shows a profile view of a formwork tube according to one embodiment.
Figure 1B:
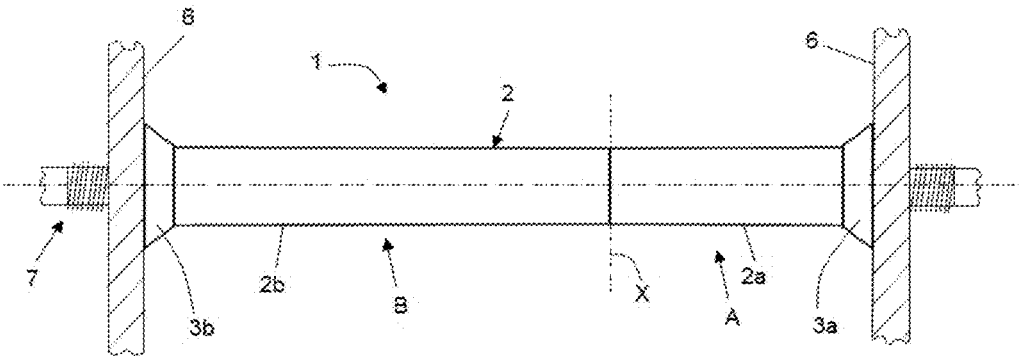
FIG. 1B schematically shows the assembly of a formwork including the formwork tube of FIG. 1A.
Figure 2:
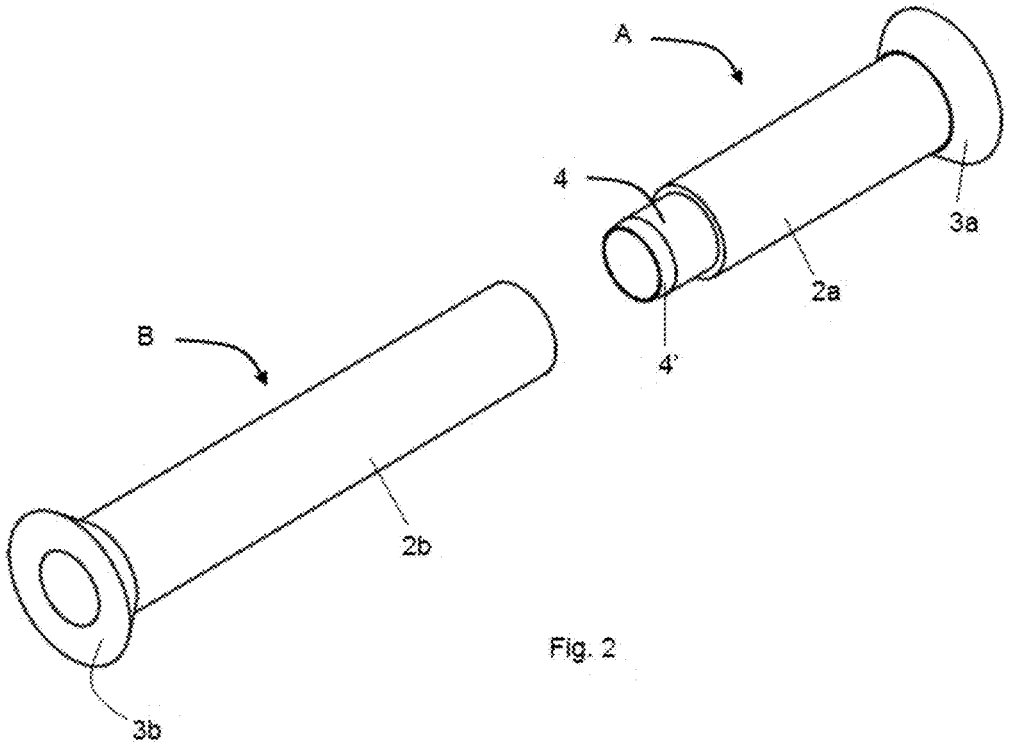
FIG. 2 is an exploded view of the formwork tube of FIG. 1A.

According to some embodiments both segments 2*a* and 2*b* are longer than the corresponding conical ends 3*a* and 3*b* and have the same external diameter, and, as stated above, the two cylindrical segments 2*a* and 2*b* are joined to form the central portion 2 of the tube 1, as shown in FIGS. 1A, 1B and 2. The tube 1 is divided into the two portions A and B and therefore it can be separated easily allowing the extraction of the whole tube 1 from the formwork after use, pulling away from each of the portions A and B.

According to some embodiments each segment 2*a* and 2*b* is integral with the corresponding conical end 3*a* and 3*b*. That is, segment 2*a* and conical end 3*a* form a single part, and segment 2*b* and conical end 3*b* form a single part.

The tube 1 is suitable for housing therein a tie rod 7. The function of the formwork tube 1 is to protect the tie rod 7 while the concrete sets, thereby preventing the concrete from adhering to the tie rod 7. Once the concrete has set, the tie rod 7 must be extracted generating a hole on the concrete wall that must be blocked. To prevent leaks, it is increasingly common, particularly if the wall is intended for containing a fluid, such as for example, in the case of a water tank, a lubricant tank, etc., to ensure that no residues of the tube 1 remain inside the hole of the formwork or wall in order to prevent any leak, no matter how small it is.

Since both portions A and B of the tube 1 are coupled to each other in a manner that allows them to be decoupled, there is no need to couple the tie rod to each of the portions A and B, so that the assemble of the formwork and the extraction operation of the tube 1 is facilitated and the assembly and disassembly time is drastically reduced.

With the formwork tube 1, when extracting the conical ends 3*a* and 3*b*, the central portion 2 of the tube 1 is also successfully extracted preferably with the aid of an extraction tool not shown in the drawings, so the entire tube 1 is extracted in a fast, safe and clean manner with a single extraction operation at each conical end 3*a* and 3*b*. In the prior art, it is necessary to use a hammer and chisel for extracting the central portion 2 of the tube 1, as a result of the central portion being retained inside the concrete hole once the conical ends are extracted. Removal of the central portion is carried out manually and is very laborious (requiring, for example, a hammer and chisel to knock out the tube that has been retained). The operator typically ends up damaging both the recently constructed concrete wall and the tube despite being skillful.

However, with the formwork tube 1 of the invention the operation of extracting the tube 1 is very simple, it is performed without exerting hardly any physical effort and the extraction time is reduced drastically. In turn, neither the recently constructed concrete wall nor the formwork tube 1 is damaged during the extraction process of the tube 1 which allows reusing it, allowing significant cost savings.

As shown in FIGS. 1A and 1B, the partitioning plane X, which is the point at which the tube 1 is divided, is defined in the contacting area of both segments 2*a* and 2*b* which in this embodiment is a plane transverse to the tube 1 itself.

Figure 3:
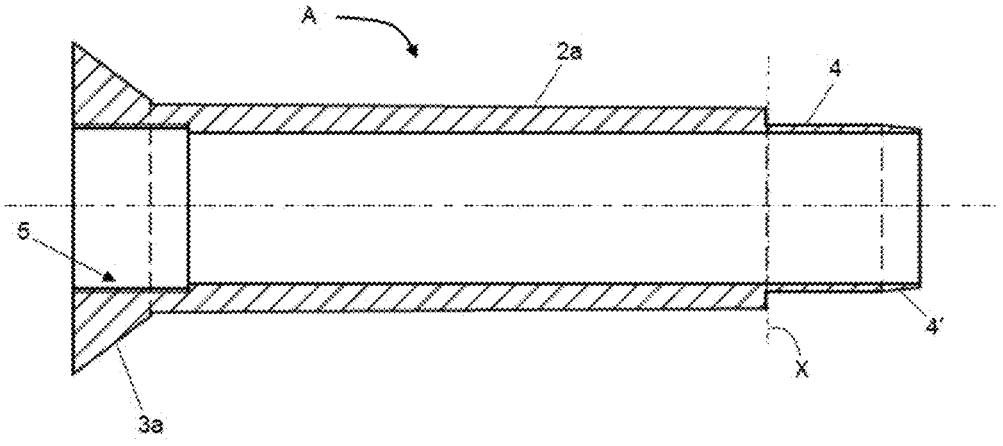
FIG. 3 is a sectional view of the first portion of the tube of FIG. 1A.

The first portion A of this embodiment also comprises the protrusion 4 which, as shown in FIGS. 2 and 3, projects from the partitioning plane X and is housed inside the second segment 2*b* during the setting of the concrete. When both segments 2*a* and 2*b* are coupled to one another, the central portion 2 of the tube 1 is formed giving rise to a continuous external surface, i.e., to a surface where the concrete poured onto the tube 1 does not penetrate to the interior of the tube 1. To facilitate the coupling of the first segment 2*a* and the second segment 2*b*, the protrusion 4 in this embodiment also comprises the chamfer 4' at its free end which aids in introducing the first segment 2*a* into the second segment 2*b*.

The protrusion 4 is long enough to ensure that the tube 1 does not become undone, i.e., that it does not separate, when the concrete is poured onto the tube 1, avoiding any discontinuity in the outermost surface of the tube 1. The protrusion 4 is radially smaller than the corresponding portion A or B, namely the outer diameter of the protrusion 4 is slightly smaller than the inner diameter of the second portion B, i.e., small enough so that the protrusion 4 can be introduced into the second portion B without a lot of effort, in turn being coupled to said second portion B. But at the same time, it is recommended that the clearance of the coupling area is sufficient to allow the two portions A and B to remain joined, which facilitates the formwork assembly operations.

The first portion A of the tube 1 may be shorter than the second portion B, as observed in FIGS. 1A, 1B and 2, but optionally the two portions A and B could also be of the same length. Transverse tie rods 7 of different lengths could be protected by coupling portions A and B of different lengths to form walls of different thicknesses.

According to one embodiment the first portion A comprises about one third of the total length of the tube 1, as can be observed in FIG. 1A or 1B, although optionally it could also comprise one fourth of the total length, or an intermediate length.

As described above, the entire tube 1 can be easily extracted from the concrete wall after use, the first portion A being extracted from one side of the wall and the second portion B being extracted from the other side, by pulling from the corresponding conical end 3*a* and 3*b*. In the extraction operation neither the recently constructed concrete wall nor the formwork tube 1 are damaged. The formwork tube 1 is hardly stressed in the extraction operation so it comes out intact and is suitable for being reused, thereby reducing costs and contributing to the environment.

To facilitate the extraction of both portions A and B, the tube 1 preferably comprises in the inner area of each end of said tube 1, fastening means 5 configured to cooperate, during the extraction process, with an extraction tool, not shown in the drawings, facilitating the extraction of the tube 1.

Figure 4:
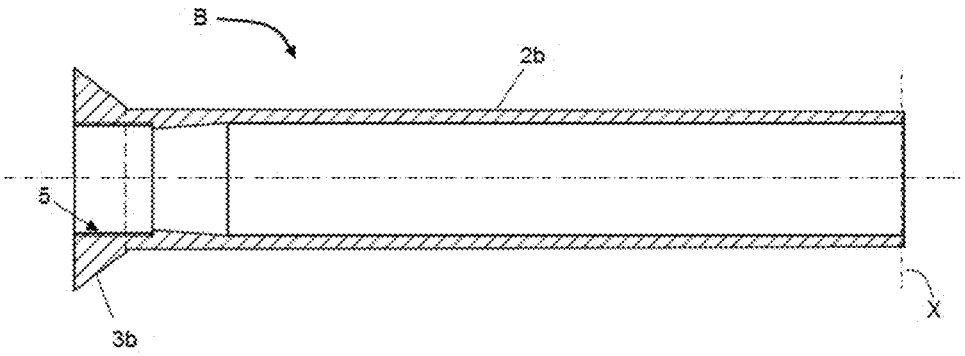
FIG. 4 is a sectional view of the second portion of the tube of FIG. 1A.

According to one embodiment the fastening means 5 comprises a threaded area as seen in FIGS. 3 and 4. The fastening means 5 allows an extraction tool to be coupled each end of the tube 1. This allows each of the tube portions A and B to be more easily extracted by a pulling on the extraction tool.

In another embodiment not shown in the drawings, the fastening means 5 can comprise a recess, i.e., a circular or semicircular groove, which allows housing the extraction tool. Depending on the extraction tool to be used, in some cases a simple smooth surface can be enough.

The tube 1 may be made of a thermoplastic material with low surface energy, for example, a polyolefin. Said property, i.e., the surface energy of a material, is defined as the sum of all intermolecular forces that are on the surface of a material, i.e., the degree of attraction or repulsion the surface of a material exerts on another material. According to one embodiment, the surface energy of said plastic material is less than 60 $mJ/m^2$, preferably less than 40 $mJ/m^2$.

According to one embodiment, the tube 1 is made of polyethylene (PE), preferably of the brand Cestilene™. This material gives the tube 1 a very smooth surface finish which further favors the extraction of the two portions A and B of the tube 1 as the concrete is prevented from adhering to the surface of the tube 1. Optionally, the tube 1 could also be made of polytetrafluoroethylene (PTFE) or PVC.

What is claimed is:

1. A formwork tube suitable for housing a tie rod that is used to fasten a first formwork to a second formwork, the formwork tube comprising:

a first tubular portion having a first end, a second end and a first conical section, the first conical section having a first end portion with a first diameter and a second end portion with a second diameter that is larger than the first diameter, an end of the second end portion of the first conical section being configured to support an inner wall of the first formwork, the first tubular portion including a first segment having a first end adjacent the first end portion of the first conical section and a second end, the first segment and the first conical section comprising a single part, the end of the second end portion of the first conical section constituting the first end of the first tubular portion and the second end of the first segment constituting the second end of the first tubular portion; and a second tubular portion having a first end, a second end and a second conical section, the second conical section having a first end portion with a first diameter and a second end portion with a second diameter that is larger than the first diameter, an end of the second end portion of the second conical section being configured to support an inner wall of the second formwork, the second tubular portion including a second segment having a first end adjacent to the first end portion of the second conical section and a second end, the second segment and the second conical section comprising a single part, the end of the second end portion of the second conical section constituting the first end of the second tubular portion and the second end of the second segment constituting the second end of the second tubular portion, the second end of the first tubular portion capable of being coupled to the second end of the second tubular portion so that no gap exists between the respective second ends and in a manner that enables the second ends to be decoupled from one another, the second ends of the first and second tubular portions are configured to be coupled to one another by a protrusion of the first tubular portion being housed inside the second tubular portion so that the first and second tubular portions abut one another along a partitioning plane from which the protrusion projects, the partitioning plane being located a distance away from the first end portion of each of the first and second conical sections, the first and second tubular portions being axially aligned when coupled together, when coupled together the second ends of the first and second tubular portions are capable of being decoupled by an axial pulling of the first conical section in a first direction and an axially pulling of the second conical section in a second direction opposite the first direction.

2. The formwork tube according to claim 1, wherein the partitioning plane is transverse to a longitudinal axis of the first and second tubular portions.

3. The formwork tube according to claim 1, wherein an outer surface of the protrusion is cylindrical.

4. The formwork tube according to claim 3, wherein a free end of the protrusion comprises a chamfer.

5. The formwork tube according to claim 1, wherein each of the first and second segments are cylindrical, the first and second segments forming a central portion of the formwork tube.

6. The formwork tube according to claim 1, wherein the first segment and the second segment have a same external diameter.

7. The formwork tube according to claim 1, wherein the first tubular portion has a first length and the second tubular portion has a second length, the first length and second length being the same.

8. The formwork tube according to claim 1, wherein the first tubular portion has a first length and the second tubular portion has a second length, the first length and second length being different.

9. The formwork tube according to claim 1, wherein the formwork tube when assembled has a length and the first tubular portion has a length of between one fourth and one third of the length of the assembled formwork tube.

10. The formwork tube according to claim 1, wherein an inner area of each of the first and second conical sections comprises fastening means configured to cooperate with an extraction tool.

11. The formwork tube according to claim 10, wherein the fastening means comprises a threaded area.

12. The formwork tube according to claim 10, wherein the fastening means comprises a circular or semicircular groove.

13. The formwork tube according to claim 1, wherein each of the first and second tubular portions is made of a plastic material.

14. The formwork tube according to claim 13, wherein the plastic material has a surface energy of less than 60 $mJ/m^2$.

15. The formwork tube according to claim 13, wherein each of the first and second tubular portions is made of a polyolefin.

16. The formwork tube according to claim 1, wherein each of the first and second tubular portions is made of a material selected from the group consisting of polytetrafluoroethylene and polyvinyl chloride.

17. A formwork tube suitable for housing a tie rod that is used to fasten a first formwork to a second formwork, the formwork tube comprising:

a first tubular portion having a first end, a second end and a first conical section, the first conical section having a first end portion with a first diameter and a second end portion with a second diameter that is larger than the first diameter, an end of the second end portion of the first conical section being configured to support an inner wall of the first formwork, the first tubular portion including a first segment having a first end that is connected with the first end portion of the first conical section and a second end, the end of the second end portion of the first conical section constituting the first end of the first tubular portion and the second end of the first segment constituting the second end of the first tubular portion; and a second tubular portion having a first end, a second end and a second conical section, the second conical section having a first end portion with a first diameter and a second end portion with a second diameter that is larger than the first diameter, an end of the second end portion of the second conical section being configured to support an inner wall of the second formwork, the second tubular portion including a second segment having a first end that is connected to the first end portion of the second conical section and a second end, the end of the second end portion of the second conical section constituting the first end of the second tubular portion and the second end of the second segment constituting the second end of the second tubular portion, the second end of the first tubular portion capable of being coupled to the second end of the second tubular portion so that no gap exists between the respective second ends and in a manner that enables the second ends to be decoupled from one another, the second ends of the first and second tubular portions are configured to be coupled to one another by a protrusion of the first tubular portion being housed inside the second tubular portion, an outer surface of the protrusion being cylindrical with a free end of the protrusion comprising a chamfer.

18. A formwork tube suitable for housing a tie rod that is used to fasten a first formwork to a second formwork, the formwork tube comprising:

a first tubular portion having a first end, a second end and a first conical section, the first conical section having a first end portion with a first diameter and a second end portion with a second diameter that is larger than the first diameter, an end of the second end portion of the first conical section being configured to support an inner wall of the first formwork, an inner area of the first conical section including a threaded area configured to cooperate with an extraction tool, the first tubular portion including a first segment having a first end that is connected with the first end portion of the first conical section and a second end, the end of the second end portion of the first conical section constituting the first end of the first tubular portion and the second end of the first segment constituting the second end of the first tubular portion; and a second tubular portion having a first end, a second end and a second conical section, the second conical section having a first end portion with a first diameter and a second end portion with a second diameter that is larger than the first diameter, an end of the second end portion of the second conical section being configured to support an inner wall of the second formwork, an inner area of the second conical section including a threaded area configured to cooperate with the extraction tool, the second tubular portion including a second segment having a first end that is connected to the first end portion of the second conical section and a second end, the end of the second end portion of the second conical section constituting the first end of the second tubular portion and the second end of the second segment constituting the second end of the second tubular portion, the second end of the first tubular portion capable of being coupled to the second end of the second tubular portion so that no gap exists between the respective second ends and in a manner that enables the second ends to be decoupled from one another.

19. A formwork tube suitable for housing a tie rod that is used to fasten a first formwork to a second formwork, the formwork tube comprising:

a first tubular portion having a first end, a second end and a first conical section, the first conical section having a first end portion with a first diameter and a second end portion with a second diameter that is larger than the first diameter, an end of the second end portion of the first conical section being configured to support an inner wall of the first formwork, an inner area of the first conical section including a circular or semicircular groove configured to cooperate with an extraction tool, the first tubular portion including a first segment having a first end that is connected with the first end portion of the first conical section and a second end, the end of the second end portion of the first conical section constituting the first end of the first tubular portion and the second end of the first segment constituting the second end of the first tubular portion; and a second tubular portion having a first end, a second end and a second conical section, the second conical section having a first end portion with a first diameter and a second end portion with a second diameter that is larger than the first diameter, an end of the second end portion of the second conical section being configured to support an inner wall of the second formwork, an inner area of the second conical section including a circular or semicircular groove configured to cooperate with the extraction tool, the second tubular portion including a second segment having a first end that is connected to the first end portion of the second conical section and a second end, the end of the second end portion of the second conical section constituting the first end of the second tubular portion and the second end of the second segment constituting the second end of the second tubular portion, the second end of the first tubular portion capable of being coupled to the second end of the second tubular portion so that no gap exists between the respective second ends and in a manner that enables the second ends to be decoupled from one another.

* * * * *